US007985316B2

(12) United States Patent
Gates et al.

(10) Patent No.: US 7,985,316 B2
(45) Date of Patent: Jul. 26, 2011

(54) ADHESIVE APPLICATOR SYSTEMS AND METHODS

(75) Inventors: Jon A. Gates, Honey Creek, IA (US); Fred C. Casto, Omaha, NE (US); Jeffrey G. Nowlin, Council Bluffs, IA (US); Timothy J. Walpus, Omaha, NE (US); Corey Dean Tunink, La Vista, NE (US)

(73) Assignee: First Data Corporation, Greenwood Village, CO (US)

( * ) Notice: Subject to any disclaimer, the term of this patent is extended or adjusted under 35 U.S.C. 154(b) by 1260 days.

(21) Appl. No.: 11/207,166

(22) Filed: Aug. 17, 2005

(65) Prior Publication Data

US 2007/0039685 A1 Feb. 22, 2007

(51) Int. Cl.
*B32B 37/00* (2006.01)

(52) U.S. Cl. ..... 156/249

(58) Field of Classification Search ..... 156/351, 156/540–542, 566
See application file for complete search history.

(56) References Cited

U.S. PATENT DOCUMENTS 3,793,114 A * 2/1974 Thomas ..... 156/361
4,321,103 A * 3/1982 Lindstrom et al. ..... 156/351
4,555,070 A * 11/1985 Pali ..... 242/420.3
4,589,943 A * 5/1986 Kimball et al. ..... 156/256
5,587,043 A * 12/1996 Hying et al. ..... 156/566
5,938,890 A * 8/1999 Schlinkmann et al. ..... 156/541
6,558,490 B2 * 5/2003 Klein et al. ..... 156/64
7,090,734 B2 * 8/2006 Aster et al. ..... 156/64
7,404,516 B2 * 7/2008 McGee et al. ..... 235/380

* cited by examiner

*Primary Examiner* — Philip C Tucker
*Assistant Examiner* — Daniel Lee
(74) *Attorney, Agent, or Firm* — Kilpatrick, Townsend & Stockton, LLP

(57) ABSTRACT

Systems and method are provided for affixing attachments, such as double-sided adhesive slips, to credit cards and other presentation instruments. Exemplary systems include a conveyor configured to transport the article along an article processing path, and an attachment assembly. The attachment assembly may include an advance motor configured to advance an attachment web along a web path, a peeler disposed along the web path and configured to separate an anchor portion of the attachment away from the attachment web, and a positioner disposed along the web path and configured to adjust the position of the web path relative to the article processing path, such that the anchor portion of the attachment is contacted with the article when the positioner moves the web path within sufficient proximity of the article processing path.

11 Claims, 6 Drawing Sheets

ADHESIVE APPLICATOR SYSTEMS AND METHODS

BACKGROUND OF THE INVENTION

The present invention is related to adhesive applicators, and more particularly, to systems and methods for applying adhesive attachments to transaction cards.

Transaction cards, such as credit cards, debit cards, membership cards, stored value cards, and the like, are widely used. Such cards may include a variety of different indicia to identify the card and other features, such as the card issuer, the customer, terms and conditions of use, or the like, depending in part on the type of card. The information may be printed on the card using alphanumeric characters, graphics, or the like, or may be embossed into the card. Alternatively, some or all the information may be encoded on the card, such as in a magnetic strip attached to the card.

Often, it is desirable to couple transaction cards to a carrier having additional information printed thereon. For example, when a credit card is mailed to a consumer, the cards is typically affixed with a carrier such as a paper sheet or other statement containing account information and the like. Similarly, stored value cards sold in retail locations may have a carrier containing terms and conditions of use, promotional information, and other inducements to buy the card. The card may be attached to the carrier, often with an adhesive strip or some type of bonding material. In an alternative process, some have devised methods whereby two or more corners of the card are slotted into punch holes of the carrier. Yet current approaches for coupling cards with carriers often suffer from certain drawbacks. For example, systems for punching D-holes into carrier sheets can be expensive and difficult to operate. Relatedly, it has been found that cards often become dislodged from carrier punch holes as a result of post office handling procedures. Some have proposed the use of gummy glue or other removable low melt adhesives for attaching cards with carriers. However, known adhesive applicators such as these are often prohibitively expensive. Accordingly, improved systems and methods are needed for affixing cards and other articles to carriers. The present invention provides such a solution to such needs.

BRIEF SUMMARY OF THE INVENTION

According to one exemplary embodiment, the present invention provides systems and methods for affixing an attachment, for example a double sided adhesive strip, to an article such as a credit card or other presentation instrument. Advantageously, the present invention provides less expensive approaches that are easier to implement than other known techniques. Further, the present invention is well suited for applying such as clear or transparent adhesive slips to presentation instruments, which has heretofore been difficult to achieve in an economically feasible manner.

In a first aspect, the present invention provides an applicator system for applying an attachment to an article. The system can include a conveyor configured to transport the article along an article processing path, and an attachment assembly. The attachment assembly may include an advance motor configured to advance an attachment web along a web path, a peeler disposed along the web path and configured to separate an anchor portion of the attachment away from the attachment web, and a positioner disposed along the web path and configured to adjust the position of the web path relative to the article processing path, such that the anchor portion of the attachment is contacted with the article when the positioner moves the web path within sufficient proximity of the article processing path. In a related embodiment, the applicator system includes a staging sensor aligned to detect the presence of the anchor portion of the attachment when the anchor portion is separated from the attachment web. In some cases, the staging sensor can be an RF sensor.

The positioner can include an activatable solenoid, such that the solenoid when activated is adapted to induce the positioner to move the web path toward the article processing path, and when deactivated is adapted to allow the positioner to move the web path away from the article processing path. In a related aspect, the web path can extend from a source spool to a take-up spool. The system can also include a take-up spool motor configured to modulate rotation of the take-up spool to adjust slack in the attachment web. In some aspects, the attachment includes a double-sided adhesive slip. In other aspects, the article includes a card body having machine readable account information stored thereon, and the attachment includes a protective device that prevents the account information from being read by a machine when the protective device is placed over the account information.

In another aspect, the present invention provides a method of applying an attachment to an article. The method can include transporting the article along an article processing path, advancing an attachment web along a web path, separating an anchor portion of the attachment away from the attachment web, and moving the web path within sufficient proximity of the article processing path to cause the anchor portion of the attachment to contact the article. The method may also include detecting the presence of the anchor portion of the attachment when the anchor portion is separated from the attachment web, using a staging sensor. In some cases, the presence of the anchor potion of the attachment is detected using an RF sensor. In a related aspect, the step of moving the web path includes activating a solenoid to induce a positioner to move the web path toward the article processing path. The step of moving the web path can also include deactivating the solenoid to allow the positioner to move the web path away from the article processing path. In another related aspect, the step of advancing the attachment web along a web path includes advancing the attachment web from a source spool to a take-up spool. Similarly, methods of the present invention may include adjusting slack in the attachment web by modulating rotation of the take-up spool with a take-up spool motor. In some aspects, the present methods include affixing a double-sided adhesive slip to an article. In related aspects, the present methods include affixing a protective device to a card body having machine readable account information stored thereon, and the protective device prevents the account information from being read by a machine when the protective device is placed over the account information.

In still another aspect, the present invention provides a method for constructing an applicator system for applying an attachment to an article. The method can include coupling a system frame with a conveyor configured to transport the article along an article processing path, and coupling the system frame with an attachment assembly. The attachment assembly can include an advance motor configured to advance an attachment web along a web path, a peeler disposed along the web path and configured to separate an anchor portion of the attachment away from the attachment web, and a positioner disposed along the web path and configured to adjust the position of the web path relative to the article processing path, such that the anchor portion of the attachment is contacted with the article when the positioner moves the web path within sufficient proximity of the article processing path. The method can also include coupling the system frame with a staging sensor and aligning the staging sensor to detect the presence of the anchor portion of the attachment when the anchor portion is separated from the attachment web. In a related aspect, the positioner can include an activatable solenoid, such that the solenoid when activated is adapted to induce the positioner to move the web path toward the article processing path, and when deactivated is adapted to allow the positioner to move the web path away from the article processing path when in an inactive state.

DETAILED DESCRIPTION OF THE INVENTION

Figure 1:
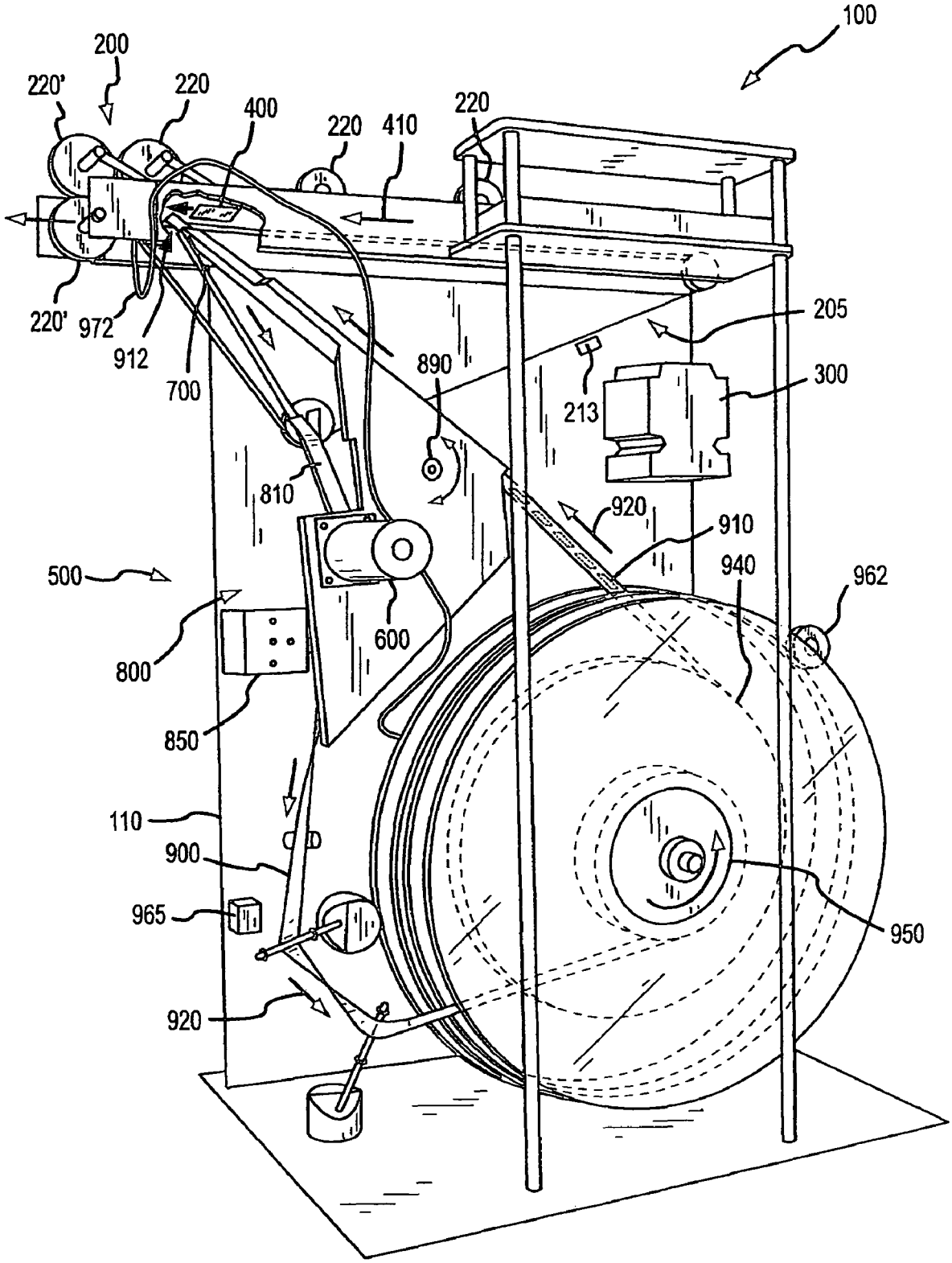
FIG. 1 illustrates a perspective view of an applicator system according to one embodiment of the present invention.

The present invention provides systems and method for affixing attachments such as double-sided adhesive strips to presentation instruments and other articles. These techniques provide, for example, an economical and efficient approach to firmly securing credit cards to statements or other carriers, such that the card and the carrier do not become separated during mailing or other handling procedures. Turning now to the drawings, FIG. 1 illustrates an applicator system 100 according to one embodiment of the present invention. Applicator system 100 includes a system frame 110 coupled with a conveyor 200 and an attachment assembly 500. Conveyor 200 is configured to transport an article 400 such as a credit card along an article processing path 410. This can be accomplished, for example, by various combinations of conveyor belts 205 and friction wheels 220. Typically, attachment assembly 500 includes an advance motor 600 that advances an attachment web 900 along a web path 920, a peeler 700 disposed along web path 920 for separating an anchor portion 912 of an attachment 910 away from attachment web 900, and a positioner 800 disposed along web path 920 for adjusting the position of web path 920 relative to article processing path 410, such that anchor portion 912 of attachment 910 is contacted with article 400 when positioner 800 moves web path 920 within sufficient proximity of article processing path 410.

In many embodiments, applicator system 100 also includes a staging sensor 970 (shown in FIG. 4) coupled with staging sensor cable 972, where staging sensor 970 is aligned to detect the presence of anchor portion 912 of attachment 910 when it is separated from attachment web 900. Staging sensor 970 is often a photoelectric sensor or an RF sensor, although it is appreciated that any of a variety of other sensor types may be used. In some cases, staging sensor 970 can be an Allen Bradley series 42 KB sensor (Rockwell Automation, Inc., Milwaukee, Wis.). Applicator system 100 also includes an activatable solenoid 850. When activated, solenoid 850 induces positioner 800 to move a portion of web path 920 toward article processing path 410. When deactivated, solenoid 850 allows positioner 800 to move a portion of web path 920 away from article processing path 410. Web path 920 is usually defined by attachment web 900, and extends from a source spool 940 to a take-up spool 950. Take-up spool motor 960 operates to modulate rotation of take-up spool 950 so as to adjust slack in attachment web 900. Toward this end, system 100 includes a slack sensor 965 disposed along web path 920 and in operative association with take-up spool motor 960.

In some cases, article 400 is affixed with attachment 910, and then prepared for distribution. In other cases, attachment 910 operates as an intermediate coupling between article 400 and another item (not shown), and the resulting combination is then prepared for distribution. Attachment web 900 typically includes a plurality of attachments 910, which can be, for example, single-sided or double-sided adhesive slips. Relatedly, attachments 910 can be either transparent or opaque.

It is appreciated that article 400 can be any of a variety of transaction instruments, such as credit cards, debit cards such as ATM cards, bank cards, prepaid phone cards, airline cards, frequent buyer cards, casino cards, hotel room door access cards, insurance cards, library cards, discount cards, membership cards, entertainment cards, travel cards, supermarket check-out cards, retail store charge cards, gift cards, calendar cards, restaurant tip cards, driver's licenses or other identification cards, various stored-value cards, or any other type of financial, healthcare, or transaction presentation instrument, or the like. Exemplary articles are further discussed in U.S. patent application Ser. No. 09/971,303 filed Oct. 3, 2001; Ser. No. 10/421,604 filed Apr. 22, 2003; Ser. No. 10/922,815 filed Aug. 19, 2004; and Ser. No. 11/155,323 filed Jun. 17, 2005; the entire contents of which are incorporated herein by reference. In some embodiments, article 400 is a card body having machine readable account information stored thereon, and attachment 910 is a protective device that prevents the account information from being read by a machine when the protective device is placed over the account information. Exemplary protective devices are discussed in U.S. patent application Ser. No. 11/117,606 filed Apr. 27, 2005, the entire contents of which are incorporated herein by reference. Article 400 may also be a business card, a mailing insert, a coupon, an address label, a product sample, a key, a calendar, a coin, or the like.

Where attachment 910 operates as an intermediate coupling between article 400 and another item, the other item may be, for example, a continuous form, a cut form, a paper sheet, a financial statement, a brochure or other sales literature, a promotional advertisement, a solicitation, an inducement, a carrier, or the like. Exemplary carriers are discussed in U.S. patent application Ser. No. 11/155,323 filed Jun. 17, 2005 the entire contents of which are incorporated herein by reference.

Figure 2:
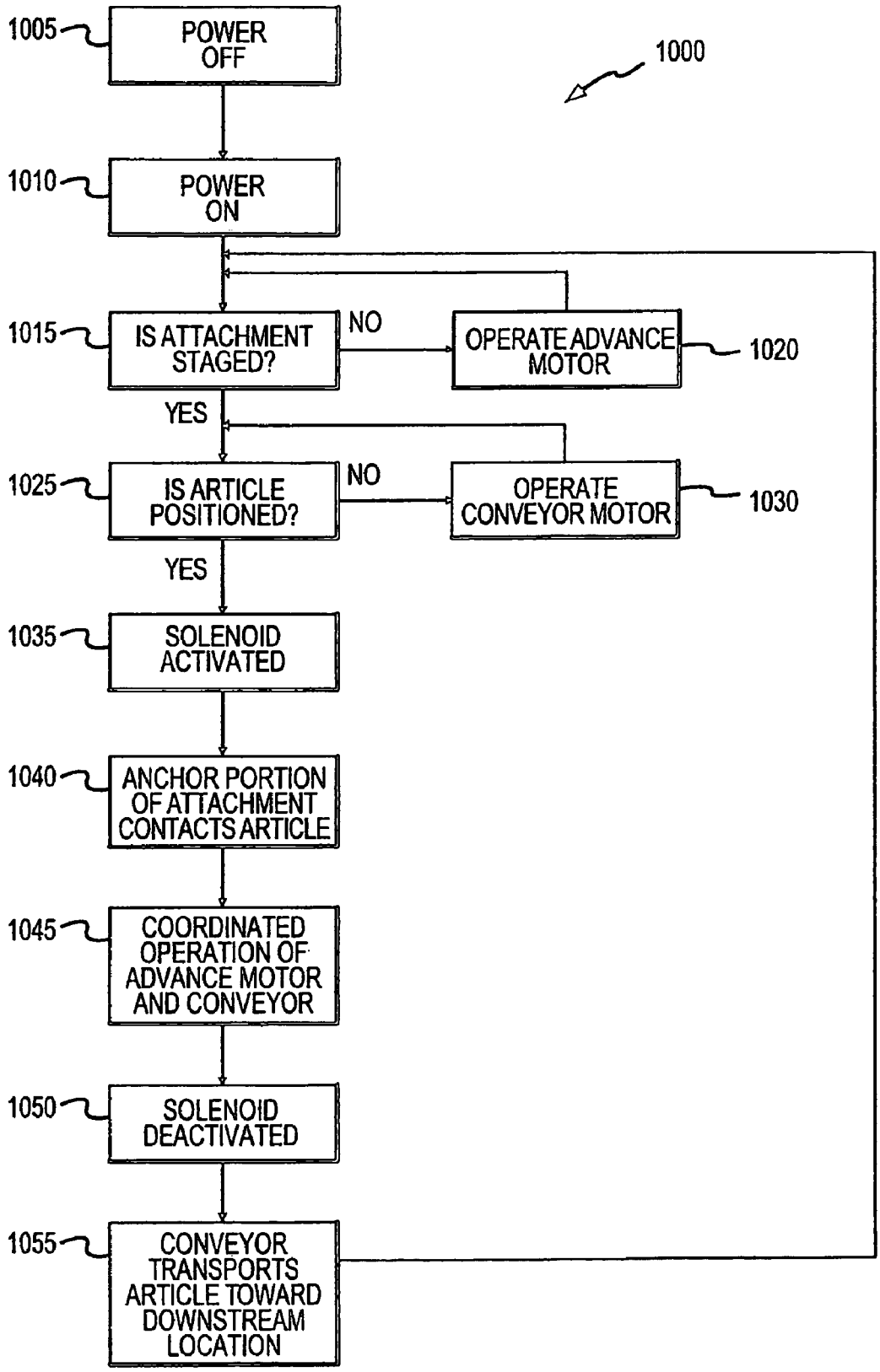
FIG. 2 depicts a schematic diagram of an applicator method according to one embodiment of the present invention.

In operation, system 100 can affix attachment 910 with article 400 according to exemplary method 1000 (shown in FIG. 2). In a preliminary step, before power to system 100 is turned on, attachment 910 is completely affixed with attachment web 900 and anchor portion 912 is not detected by staging sensor 970. With continuing supplemental reference to the exemplary procedural flowchart provided in FIG. 2, this initial status of system 100 is represented by step 1005. System 100 can then be powered on by an operator or by some other means as indicated by step 1010. When system 100 is activated, staging sensor 970 detects for the presence of anchor portion 912 of attachment 910 as indicated by step 1015. If staging sensor 970 does not detect anchor portion 912, or if anchor portion 912 is not staged, advance motor 600 advances attachment web 900 along web path 920 in a counterclockwise direction as indicated by step 1020. In this way, advance motor 600 can receive input from or otherwise be in operative association with staging sensor 970. As attachment 910 travels across peeler 700, anchor portion 912 of attachment 910 separates from attachment web 900. Web advancement continues until anchor portion 912 is detected by staging sensor 970, which indicates that anchor portion 912 has been effectively staged and ready to be affixed with article 400.

Article 400 is received onto and advanced along article processing path 410. Typically, an article input sensor 430 is configured to detect the presence of article 400 at an upstream location (shown in FIG. 5). When article input sensor 430 detects article 400, a signal can be transmitted to smart motor 300, thereby prompting smart motor 300 to activate conveyor 200 to advance article 400 along article processing path 410 in a downstream direction toward article output sensor 420. In this sense, article input sensor 430 is in operative association with smart motor 300.

Before, during, or even after the staging process of anchor portion 912, article output sensor 420 (shown in FIG. 4) detects for the presence of article 400 as indicated by step 1025. If article output sensor 420 does not detect article 400, conveyor 200 advances or continues to advance article 400 along article processing path 410 toward article output sensor 420 as indicated by step 1030. In some embodiments, such activation of conveyor 200 may be under the control of smart motor 300. In related embodiments, the staging process of anchor portion 912 can proceed independently of steps involved with advancement of article 400. Conveyor 200 continues to advance article 400 along article processing path 410 until article 400 is detected by article output sensor 420, which indicates that article 410 is in position for contacting attachment 910.

When article output sensor 420 detects article 400, solenoid 850 is activated and thereby operates to rotate positioner 800 about pivot 890, in a clockwise direction, as indicated by step 1035. Such activation of solenoid 850 may be under the control of smart motor 300. This rotation of positioner 800 moves a portion of web path 920 toward article processing path 410, and thereby moves anchor portion 912 toward and in contact with article 400, as depicted by step 1040. As anchor portion 912 is affixed with article 400, smart motor 300 instructs conveyor 200 to advance article 400 further along article processing path 410, and in a simultaneous or otherwise coordinated fashion instructs advance motor 600 to advance attachment web 900 along web path 920, as indicated by step 1045. In this way, attachment 910 and article 400 are transported together, and the remainder of attachment 910 is smoothly affixed with article 400.

Article 400 continues to advance along conveyor 200 past article output sensor 420. When article output sensor 420 no longer detects article 400, smart motor 300 operates to deactivate solenoid 850. Alternatively, deactivation of solenoid 850 can be independent of a signal from article output sensor 420, and instead can be accomplished via timing specifications dictated by smart motor 300. As depicted by step 1050, when deactivated, solenoid 850 causes or allows positioner 800 to rotate about pivot 890 in a counterclockwise direction. This rotation of positioner 800 moves a portion of web path 920 away from article processing path 410, and toward its original position. Conveyor 200 can transport article 400 further along article processing path and toward a downstream processing location as indicted by step 1055. In some embodiments, conveyor 200 includes accelerated conveyor friction wheels 220' which are configured to rotate at an accelerated rate as compared with the other friction wheels 220.

It is appreciated that web path 920 is usually defined by attachment web 900, and extends from a source spool 940 to a take-up spool 950. System 100 typically can provide means whereby slack in attachment web 900 can be reduced or otherwise adjusted. For example, take-up spool motor 960 operates to modulate rotation of take-up spool 950 so as to adjust slack in attachment web 900. Toward this end, system 100 includes a slack sensor 965 disposed along web path 920 and in operative association with take-up spool motor 960. If slack sensor 965 detects excessive slack in attachment web 900, take-up spool motor 960 can initiate or increase rotation of take-up spool 950 in a counterclockwise direction, thereby providing more tension in attachment web 900. In some embodiments, slack sensor 965 and take-up spool motor 960 operate on a continuous basis, such that as soon as slack is generated in attachment web 900, it is detected by slack sensor 965 and consequently reduced due to activation of take-up spool motor 960. System 100 is then poised to repeat the procedure as describe above for any desired number of times. In brief, advance motor 600 advances attachment web 900 to stage anchor portion 912, and conveyor 200 transports article 400 along article processing path 410. Anchor portion 912 is affixed with article 400, and slack is removed from web 900.

Figure 3:
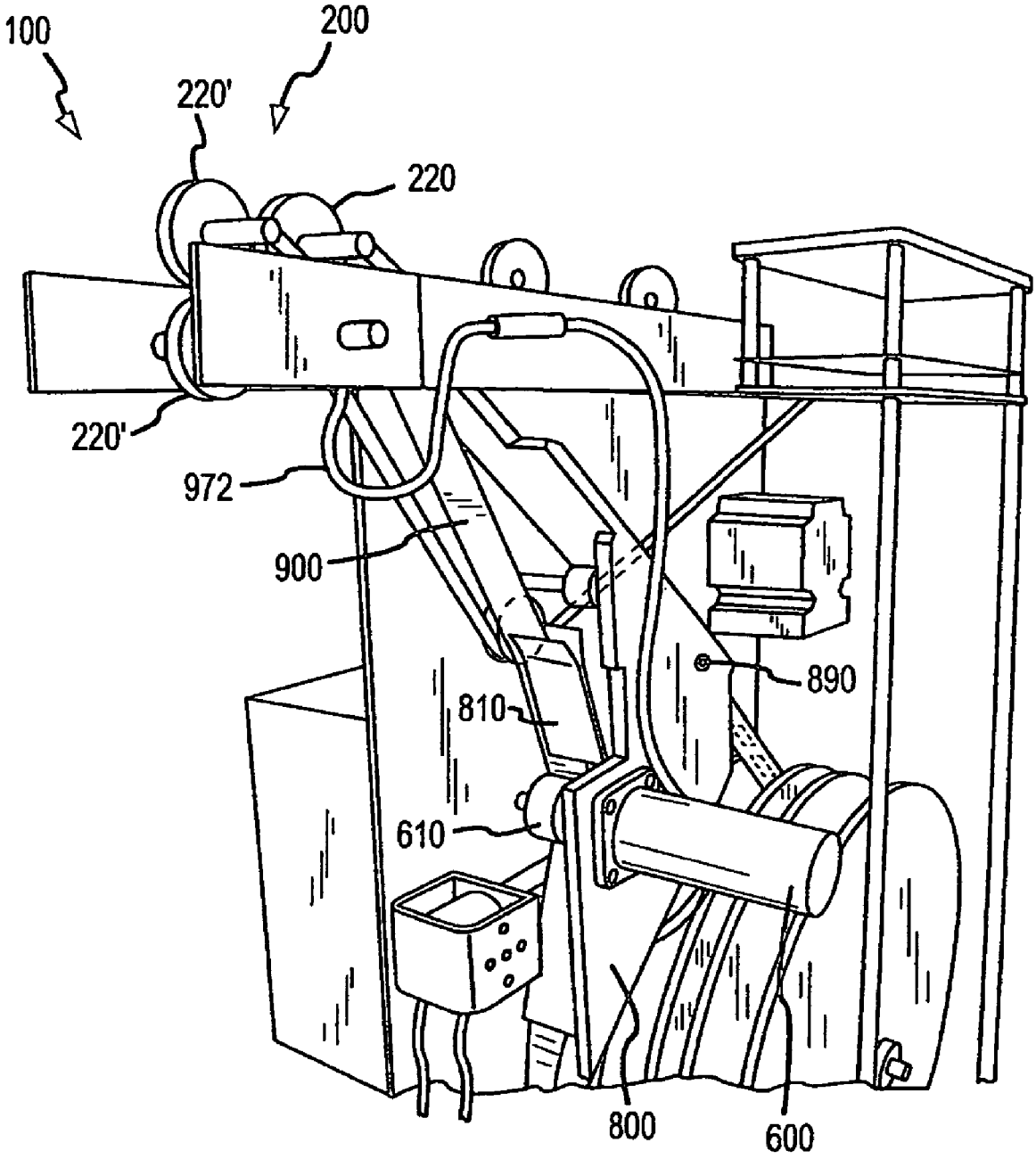
FIG. 3 provides a partial perspective view of an applicator system according to one embodiment of the present invention.

FIG. 3 provides another illustrative view of system 100. As seen here, positioner 800 includes a deflection chute 810 that guides attachment web 900 from peeler 700 (not shown) toward a advance motor friction wheel 610 of advance motor 600. Clockwise rotation of advance motor friction wheel 610 typically causes counterclockwise rotation of attachment web 900. Because attachments 910 are typically removed from attachment web 900 at or near peeler 700, the attachment web 900 that contacts advance motor friction wheel it typically devoid of any attachments 910.

Figure 4:
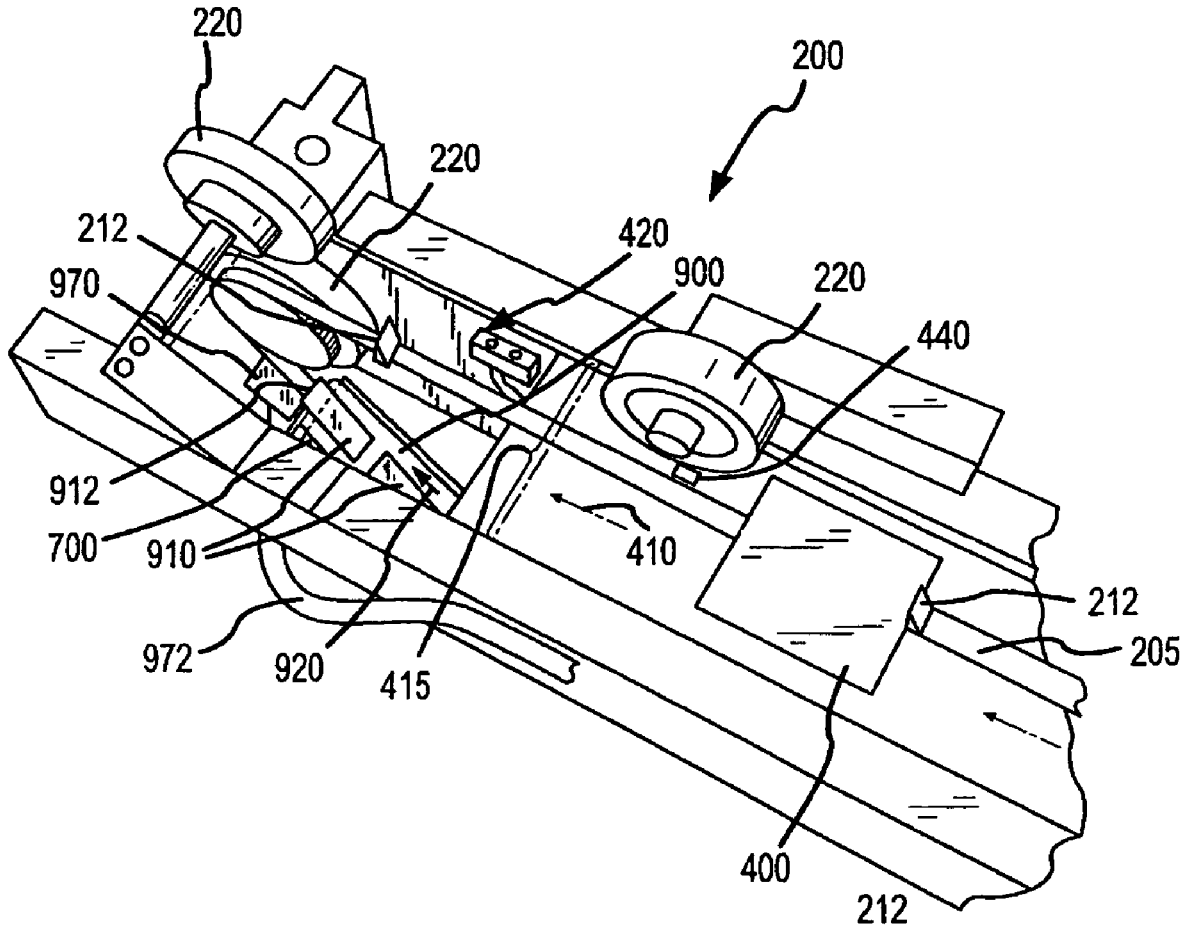
FIG. 4 shows a partial perspective view of an applicator system according to one embodiment of the present invention.

FIG. 4 shows a partial top perspective view of system 100. As noted above, when system 100 is powered on, attachment web 900 is advanced along web path 920 so that as attachment 910 moves across peeler 700, anchor portion 912 of attachment 910 separates from attachment web 900, and is thus staged for detection by staging sensor 970. Conveyor belt 205 and conveyor friction wheels 220 operate to transport article 400 along article processing path 410, across article output sensor 420. In some embodiments, conveyor belt 205 includes conveyor belt profiles 212 that can engage a trailing edge of article 400 so as to urge or otherwise facilitate conveyance of article 400 along article processing path 410. System 100 may also include a profile sensor 213 disposed at or near conveyor belt 205. Profile sensor 213 can be configured to sense conveyor belt profiles 212, and thus provide a means for detecting the movement and position of conveyor belt 205. Profile sensor 213 may be a fiber optic sensor, and may be in operative association with smart motor 300, which can be configured to control conveyor 200 based on the movement and position of conveyor belt 205.

Often, article processing path 410 is defined at least in part by conveyor tract 415. System 100 may also include a magnetic strip reader 440 or other means for reading identification information from article 400. Magnetic strip reader 440 may be disposed along article processing path 410, and typically is situated beneath a conveyor friction wheel 220. Often, such identification information can be used in other article-processing steps. For example, the identification information can be used to match article 400 with a particular carrier to which it is affixed with at a downstream processing location. More particularly, the identification information can be used to match article 400 with a particular customer financial statement or other carrier, so as to insure that article 400 is sent to the intended recipient. Exemplary magnetic strip readers are discussed in U.S. patent application Ser. No. 11/153,218 filed Jun. 14, 2005 the entire contents of which are incorporated herein by reference.

Figure 5:
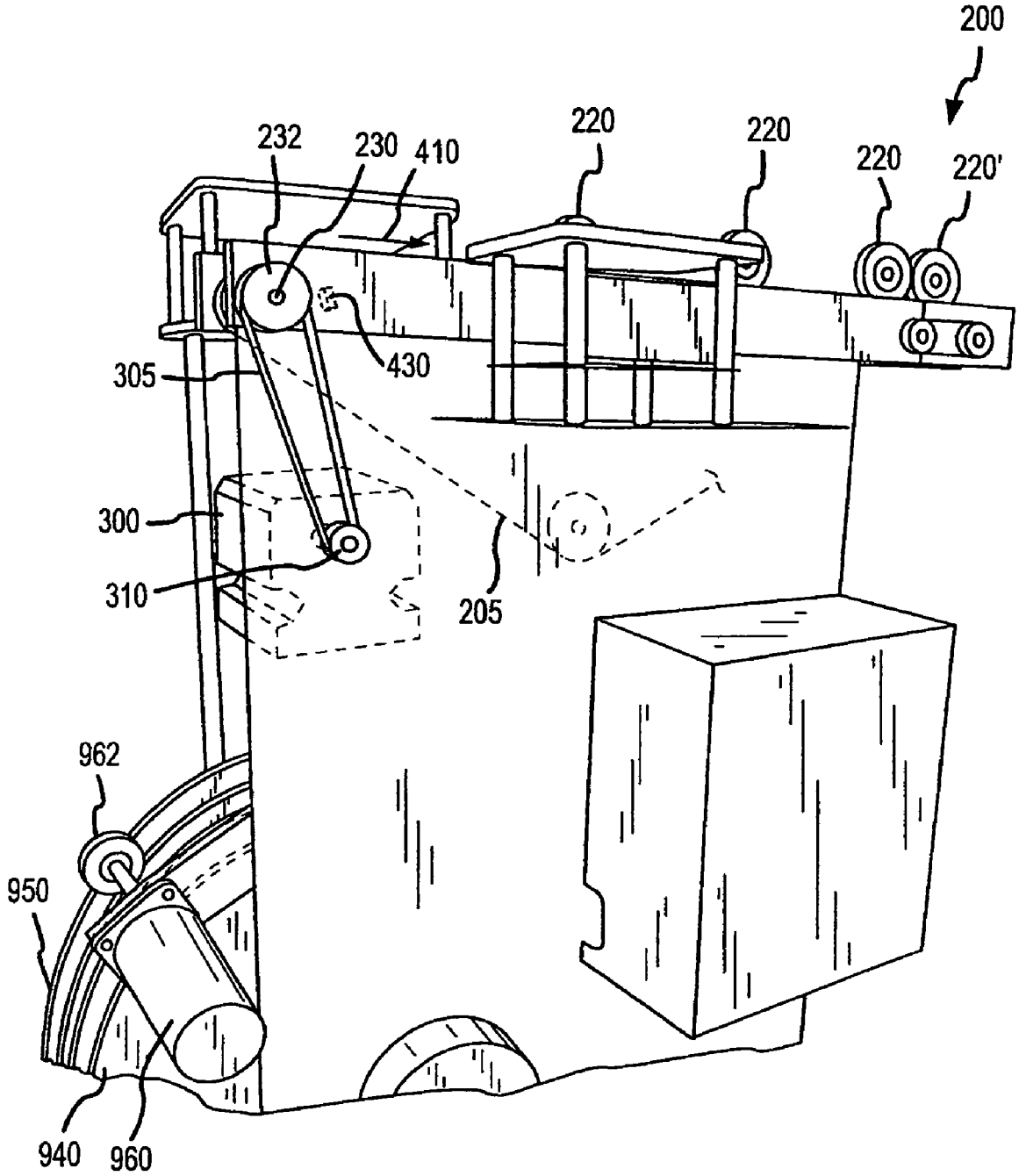
FIG. 5 shows a partial perspective view of an applicator system according to one embodiment of the present invention.

FIG. 5 illustrates a rear perspective view of applicator system 100. Smart motor 300 includes a smart wheel pulley 310 in operative association with, via a smart motor belt 305, a conveyor roller pulley 232 of a conveyor pulley 230. Take-up spool motor 960 includes a take-up spool motor friction wheel 962 that engages take-up spool 950. Smart motor 300 often includes or is associated with various software and/or hardware modules for controlling the operation of smart motor 300 and/or other system or non-system components. For example, smart motor 300 can include a computer program product for determining when to activate advance motor 600 or solenoid 850. Relatedly, smart motor 300 can include or be associated with various software and/or hardware modules for accepting input from other system or non-system components. For example, smart motor 300 can include a computer program product for accepting input from system sensors or components such as input sensor 430, output sensor 420, profile sensor 213, and the like. It is appreciated that such computer program products can include code for carrying out the various steps, as well as a computer-readable medium for storing the code.

Relatedly, each of the steps described herein may be performed using a computer or other processor having hardware, software, and/or firmware. The various method steps may be performed by modules, and the modules may comprise any of a wide variety of digital and/or analog data processing hardware and/or software arranged to perform the method steps. The modules may optionally include data processing hardware adapted to perform one or more of these steps by having appropriate machine programming code associated therewith. Modules for two or more steps (or portions of two or more steps) may be integrated into a single processor board or separated into different processor boards in any of a wide variety of integrated and/or distributed processing architectures. These methods and systems will often employ a tangible media embodying machine-readable code with instructions for performing the method steps. Suitable tangible media may comprise a memory (including a volatile memory and/or a non-volatile memory), a storage media (such as a magnetic recording on a floppy disk, a hard disk, a tape, or the like; on an optical memory such as a CD, a CD-R/W, a CD-ROM, a DVD, or the like; or any other digital or analog storage media), or the like.

It will be apparent that substantial variations may be used in accordance with specific requirements. For example, customized hardware might also be used and/or particular elements might be implemented in hardware, software (including portable software, such as applets), or both. Further, system 100 can include or be in operative association with other computing devices such as a network input/output device, a computer terminal, a personal computer, a portable computer, a workstation, a network computer, or any other data processing system. Likewise, many of the hardware and software components discussed herein can be integrated with or configured to interface with other components of system 100 or with other non-system components.

Figure 6:
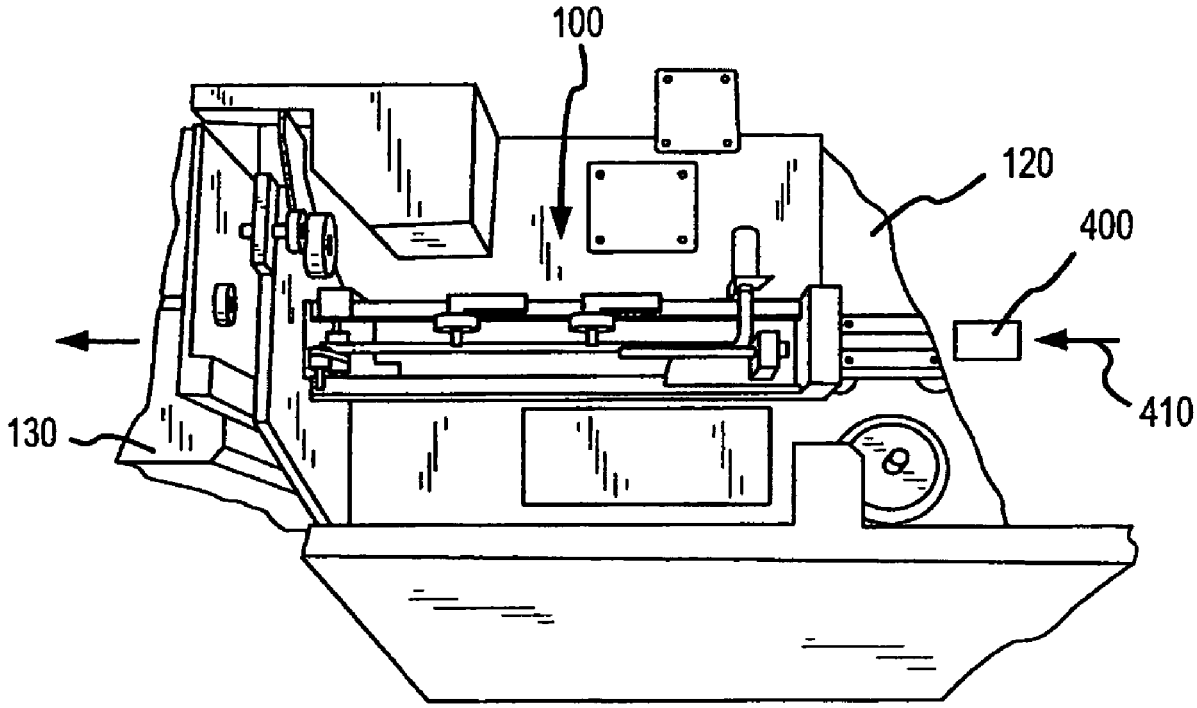
FIG. 6 shows a partial perspective view of an applicator system according to one embodiment of the present invention.

FIG. 6 shows top view of system 100 as it is integrated with other article processing modules. It is appreciated that any of a variety of article processing modules may be disposed upstream and/or downstream from system 100. For example, in some embodiments article 400 moves from a picker module 120 along article processing path 410, through applicator system 100, and then on toward a placement module 130. Picker module 120 can be configured to retrieve a single article from a stack of articles and advance the article toward article processing path 410. Placement module 130 can be configured to place one or more articles on an item such as a financial statement, which in some cases may be on a continuous web. Subsequent processing steps may include separating the web into individual sheets, removing tractor pin edges from the web or sheets, folding the individual sheets, inserting the sheets into envelopes, and the like. In some cases, this process may result in a stuffed envelope that includes a card affixed with a carrier. In other cases, a resulting stuffed envelope may include a card affixed with a carrier, along with one or more additional inserts.

While the above provides a full and complete disclosure of certain embodiments of the present invention, various modifications, alternate constructions and equivalents may be employed as desired. Therefore, the above description and illustrations should not be construed as limiting the invention, which is defined by the appended claims.

What is claimed is:

1. An applicator system for applying an attachment to an article, the system comprising:

a conveyor configured to transport the article along an article processing path; and an attachment assembly comprising:

an advance motor configured to advance an attachment web along a web path;

a peeler disposed along the web path and configured to separate an anchor portion of the attachment away from the attachment web; and a positioner disposed along the web path and configured to rotate about a pivot point to adjust the position of the web path relative to the article processing path between a first position and a second position, wherein in the first position, the web path is rotated toward the article processing path such that the anchor portion of the attachment is moved toward and into contact with the article, and wherein in the second position, the web path is rotated away from the article processing path, wherein the conveyor and advance motor are configured to engage simultaneously such that the attachment is affixed to the article by the peeler;

the article comprises a card body having machine readable account information stored thereon, and the attachment comprises a protective device that prevents the account information from being read by a machine when the protective device is placed over the account information.

2. The applicator system of claim 1, further comprising a staging sensor aligned to detect the presence of the anchor portion of the attachment when the anchor portion is separated from the attachment web.

3. The applicator system of claim 2, wherein the staging sensor comprises an RF sensor.

4. The applicator system of claim 1, wherein the web path extends from a source spool to a take-up spool.

5. The applicator system of claim 4, further comprising a take-up spool motor configured to modulate rotation of the take-up spool to adjust slack in the attachment web.

6. The applicator system of claim 1, wherein the attachment comprises a double-sided adhesive slip.

7. The applicator system of claim 1, further comprising a smart motor, wherein the smart motor is configured to simultaneously activate the conveyor to advance the article and instruct the advance motor to advance the attachment web.

8. The applicator system of claim 7, wherein the smart motor is further configured to control a solenoid that rotates the positioner between the first and second position.

9. An applicator system for applying an attachment to an article, the system comprising:

a conveyor configured to transport the article along an article processing path; and an attachment assembly comprising:

an advance motor configured to advance an attachment web along a web path;

a peeler disposed along the web path and configured to separate an anchor portion of the attachment away from the attachment web, wherein the conveyor and advance motor are configured to engage simultaneously such that the attachment is affixed to the article by the peeler; and a positioner disposed along the web path and configured to:

adjust the position of the web path relative to the article processing path by partially rotating the attachment web and the attachment about a pivot point between a first position and a second position, wherein in the first position, the web path is rotated toward the article processing path such that the anchor portion of the attachment is moved toward and into contact with the article, and wherein in the second position, the web path is rotated away from the article processing path, wherein the positioner comprises an activatable solenoid, such that the solenoid when activated is adapted to induce the positioner to move the web path toward the article processing path, and when deactivated is adapted to allow the positioner to move the web path away from the article processing path.

10. The applicator system of claim 9, further comprising a smart motor, wherein the smart motor is configured to simultaneously activate the conveyor to advance the article and instruct the advance motor to advance the attachment web.

11. The applicator system of claim 10, wherein the smart motor is further configured to control the activatable solenoid to rotate the positioner between the first and second position.

* * * * *